US007322212B2

(12) United States Patent
Golove et al.

(10) Patent No.: US 7,322,212 B2
(45) **Date of Patent: *Jan. 29, 2008**

(54) FINGER RINGS WITH INTERCHANGEABLE OR MOVABLE SETTINGS AND ATTACHABLE CHARMS

(75) Inventors: Beth Golove, 12030 Rebecca's Run Dr., Winter Garden, FL (US) 34787; Mark Kaplan, Fair Lawn, NJ (US); Daniele E. Paglia, Far Hills, NJ (US); Steven Kerner, Manalapan, NJ (US)

(73) Assignee: Beth Golove, Winter Garden, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/346,418

(22) Filed: Feb. 2, 2006

(65) Prior Publication Data

US 2006/0185391 A1 Aug. 24, 2006

Related U.S. Application Data

(63) Continuation-in-part of application No. 11/061,809, filed on Feb. 18, 2005, now Pat. No. 7,222,503.

(51) Int. Cl.
*A44C 9/00* (2006.01)

(52) U.S. Cl. ..... 63/15; 63/23; 63/40

(58) Field of Classification Search ..... 63/1.16, 63/1.17, 23, 33, 15, 40, 29.1, 29.2, 30, 31
See application file for complete search history.

(56) References Cited

U.S. PATENT DOCUMENTS 296,312 A 4/1884 Bulova
359,717 A 3/1887 Dreyfus
367,414 A 8/1887 Lamont
417,569 A 12/1889 Margileth
466,287 A 12/1891 Berlepsch
635,510 A * 10/1899 Saunders ..... 63/15
732,532 A 6/1903 Fallek
758,848 A 5/1904 Pejchar
1,166,431 A 1/1916 Capwell
1,176,028 A 3/1916 Botfield (Continued)

OTHER PUBLICATIONS

Google Images. Search results for "charm rings," results 1-20. (2 pages).

(Continued)

*Primary Examiner*—Jack W. Lavinder
(74) *Attorney, Agent, or Firm*—Gordon & Jacobson, PC

(57) ABSTRACT

An finger ring includes a movable or removable setting and a charm coupled to a short chain. The chain carrying the charm can be captured by the movable or removable setting. According to one embodiment, the setting has internal threads which mate with a threaded post. According to another embodiment, the setting is coupled to a slotted basket via a bayonet coupling. According to another embodiment, the setting is coupled to a slotted basket via a magnet. The charms are preferably provided in a wide range of designs, including, but not limited to holiday themes, religious themes, astrological signs, varsity letters, graduation year, wedding themes, commercial characters such as Disney characters, TV characters, messages such as "I Love You", etc. The removable settings may include different color stones to match different color clothing, birth stones, etc.

20 Claims, 13 Drawing Sheets

U.S. PATENT DOCUMENTS 1,179,025 A 4/1916 Molinaro
1,308,011 A 6/1919 Gilsey
1,691,445 A 11/1928 Meliodon
1,877,442 A 9/1932 Armstrong
2,074,643 A 3/1937 Domenego
D109,800 S 5/1938 Foss
2,316,225 A * 4/1943 De De Hoffmann et al. 63/29.1
2,354,513 A 7/1944 Fitzer
2,514,231 A * 7/1950 Fous ..... 63/29.1
2,519,152 A * 8/1950 Piotrowski ..... 63/29.1
2,586,787 A 2/1952 Conto et al.
2,883,048 A 4/1959 Lentz
3,039,279 A 6/1962 Bussel
3,115,758 A 12/1963 Eberle et al.
3,180,112 A * 4/1965 Lefkowitz ..... 63/29.1
3,273,766 A 9/1966 Cosentino
3,643,467 A 2/1972 Postel
3,739,598 A 6/1973 Postel
3,751,795 A 8/1973 Favre
4,216,567 A 8/1980 Heinz
4,259,850 A 4/1981 Lalieu
4,353,124 A 10/1982 Weinzettel et al.
4,353,225 A 10/1982 Rogers
4,519,220 A * 5/1985 Burrell ..... 63/14.5
4,794,766 A * 1/1989 Schunk et al. ..... 63/15
4,879,882 A 11/1989 Johnson et al.
4,936,115 A 6/1990 Mesica
4,977,757 A * 12/1990 Mesica et al. ..... 63/15
4,982,581 A * 1/1991 Furuyama ..... 63/29.1
5,018,365 A 5/1991 Luceno
5,022,237 A 6/1991 Monderer et al.
5,069,045 A * 12/1991 Mejias ..... 63/3
5,077,987 A 1/1992 Leith, III
5,077,989 A * 1/1992 Dillabaugh ..... 63/29.1
5,097,679 A 3/1992 Johnson et al.
5,115,649 A 5/1992 Amber
5,456,095 A * 10/1995 Tawil et al. ..... 63/29.1
5,887,448 A 3/1999 Gilbert et al.
5,987,919 A 11/1999 Hooser
5,992,177 A 11/1999 Beard
6,032,485 A 3/2000 Steinberg
6,053,009 A 4/2000 Broggian
6,116,054 A 9/2000 Czupor
6,164,292 A 12/2000 Di Maria Poole et al.
6,357,261 B1 3/2002 Cheng
6,370,912 B1 4/2002 Sutton
6,408,647 B1 6/2002 Koll
6,412,304 B1 7/2002 Adelman
6,415,629 B1 7/2002 Chan
6,581,413 B1 6/2003 Kadosh
6,698,238 B1 3/2004 Cheng
6,763,681 B1 7/2004 Klundt
6,810,685 B2 11/2004 Esposito, Jr.
2002/0020191 A1 2/2002 Chan
2004/0177647 A1 9/2004 Dennis
2005/0210920 A1* 9/2005 Kourakis ..... 63/29.1

OTHER PUBLICATIONS

Price, Jodi, "Beadworx.com—Lampwork Charm Rings by Jodi Price." GlassArtists.org. Catalog cover. (2 pages).
"Charm Rings" JF Designs Jewelry. Catalog. (1 page).
Shop Intuition charm rings, 2004. Catalog. (1 page).
"Initial Charm Ring," Earth's Treasure, 2005. Catalog. (4 pages).

* cited by examiner

FINGER RINGS WITH INTERCHANGEABLE OR MOVABLE SETTINGS AND ATTACHABLE CHARMS

This application is a continuation-in-part of Ser. No. 11/061,809 filed Feb. 18, 2005 now U.S. Pat. No. 7,222,503, the complete disclosure of which is incorporated herein by reference.

BACKGROUND OF THE INVENTION

1. Field of the Invention

This invention relates broadly to jewelry. More particularly, this invention relates to rings having interchangeable settings and attachable charms.

2. State of the Art

Jewelry is a very popular accessory, particularly among women and girls. Finger rings, bracelets and necklaces are the most popular jewelry items. Rings typically have one or more settings which carry precious or semi-precious stones. Bracelets and necklaces sometimes have hanging pendants or charms. Charm bracelets are unique in that one typically collects charms to be added to the bracelet over time. The charms usually commemorate some event, holiday, milestone, etc. Once added to the bracelet, however, charms generally are not easily removed. Eventually, the bracelet becomes full of charms and no more can be added.

SUMMARY OF THE INVENTION

It is therefore an object of the invention to provide a new and interesting item of jewelry.

It is another object of the invention to provide an item of jewelry which combines features of bracelets with rings.

It is a further object of the invention to provide an item of jewelry which is easily adaptable to suit the whim of the wearer.

In accord with these objects, which will be discussed in detail below, a ring according to the invention includes a removable or movable setting and a charm coupled to a short chain which is captured by the setting. According to one embodiment, the setting is removably threaded and the ring includes a threaded post which mates with the setting. In this embodiment the charms are coupled to washers or loops which fit over the threaded post. The presently preferred washers have ears so that multiple charms can be attached to the post with the washers lying flat relative to each other. In another embodiment, a safety catch is provided to prevent the setting from accidentally disengaging from the threaded post. The removable setting is preferably interchangeable with other settings. The interchangeable charms are preferably provided in a wide range of designs, including, but not limited to holiday themes, religious themes, astrological signs, varsity letters, graduation year, wedding themes, commercial characters such as Disney characters, TV characters, messages such as "I Love You", etc. The interchangeable settings may include different color stones to match different color clothing, birth stones, etc., or may provide different motifs such as initials.

According to a second embodiment, the removable setting is cylindrical with peripheral bayonet lock slots. The ring includes a slotted cylinder with a pair of interior bosses which are arranged to engage the bayonet lock slots on the setting. Charms are provided with a chain and an anchor. The anchors are arranged inside the slotted cylinder with the chains extending through the slots. The anchors and slots are dimensioned to prevent passage of the anchors through the slots. After the charms are so arranged, the setting is attached. Preferably, a spring is arranged between the setting and the slotted cylinder.

According to a third embodiment, the removable setting is coupled to the ring by one or more magnets.

According to a fourth embodiment which is similar to the second embodiment, the setting is not removable but is simply movable. In this embodiment, the setting is provided with a post and the ring is provided with a cylinder which receives the post. The cylinder is provided with an interior groove and the post is provided with an orthogonal boss which engages the groove. A spring is arranged around the cylinder and biases the setting away from the ring. Rotating the setting in one direction unlocks the setting and permits the setting to move up relative to the ring, making room for the anchors of the charms to be placed in the slots. The setting may be moved against the spring to close over the slots capturing the anchors of the charms. Rotation of the setting in the opposite direction locks the setting relative to the item of jewelry.

According to a fifth embodiment which is similar to the fourth embodiment, the setting post is actually a cylinder and the spring is contained therein so that it is not visible. The fifth embodiment operates in the same manner as the fourth embodiment.

Additional objects and advantages of the invention will become apparent to those skilled in the art upon reference to the detailed description taken in conjunction with the provided figures.

DETAILED DESCRIPTION OF THE PREFERRED EMBODIMENT

Figure 1:
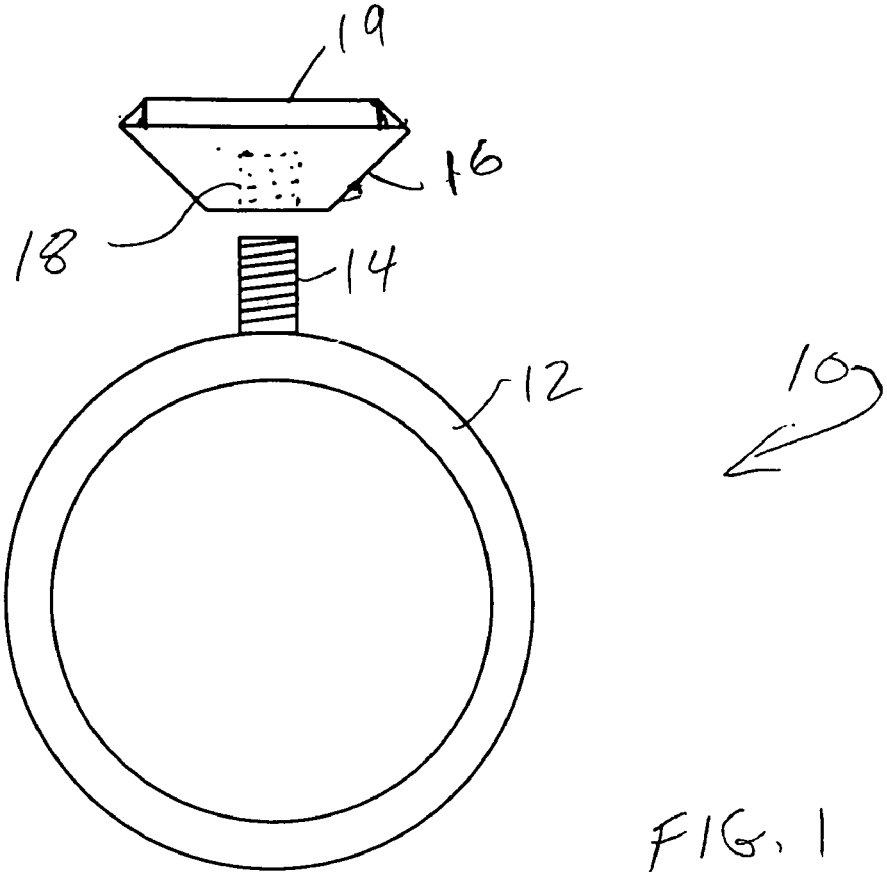
FIG. 1 is a schematic exploded side elevation view of a ring according to a first embodiment of the invention.

Turning now to FIG. 1, a finger ring 10 according to the invention includes a closed loop 12 which is dimensioned to fit comfortably over the wearer's finger, a radially outward extending threaded post 14, and a setting 16 having internal threads 18. The setting 16 preferably receives and holds a precious or semi-precious stone 19. As used herein, the term "stone" means something held by a setting for display. It is not necessarily a precious or semi-precious gemstone or even a simulation of a gemstone, as it may be a precious or other metal providing a decoration or motif, glass, crystal, etc. If desired, a safety latch (not shown) can be provided to latch the setting to the ring and/or stem.

From the foregoing, those skilled in the art will appreciate that the setting 16 is removable from and attachable to the post 14. Thus, a plurality of settings holding different stones may be interchangeably attached to the post 14 resulting in different style rings. The stones in the interchangeable settings may include different color stones to match different color clothing, birth stones, etc., or a metal "stone" with a motif or decoration. Settings which hold multiple stones may also be used. The settings are preferably made from a precious metal such as silver, gold, or platinum. However, in order to provide a ring affordable by teenage or younger girls, the settings can be made of "white metal" and the stones can be made of inexpensive materials including metal, glass or plastic.

Figure 2:
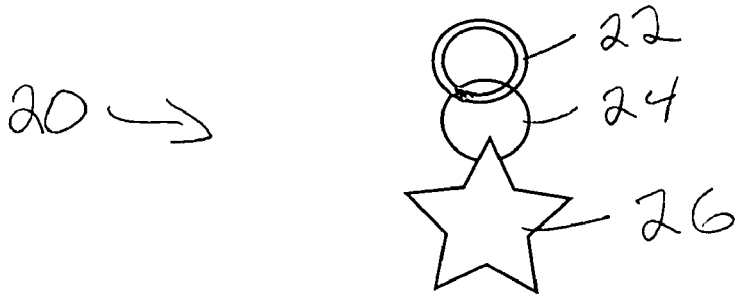
FIG. 2 is a schematic side elevation view of a charm according to the invention.

Referring now to FIG. 2, a charm 20 according to the invention includes a loop 22 coupled by one or more chain links or loops 24 to a charm element 26. According to the invention, the charms are preferably provided in a wide range of designs, including, but not limited to holiday themes, religious themes, astrological signs, varsity letters, graduation year, wedding themes, commercial characters such as Disney characters, TV characters, messages such as "I Love You", etc.

Figure 3:
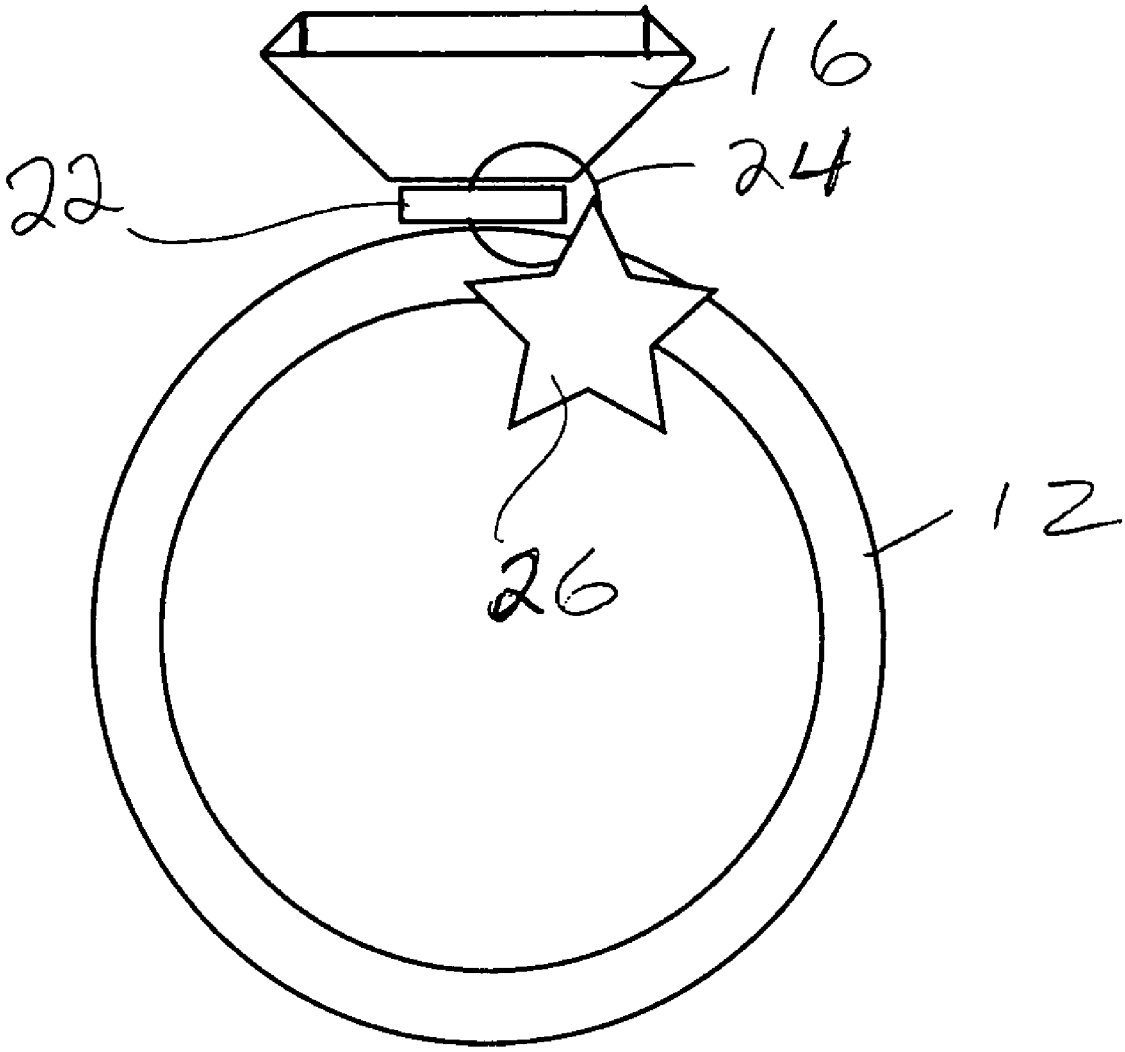
FIG. 3 is a schematic side elevation view of the charm attached to the ring.
Figure 4:
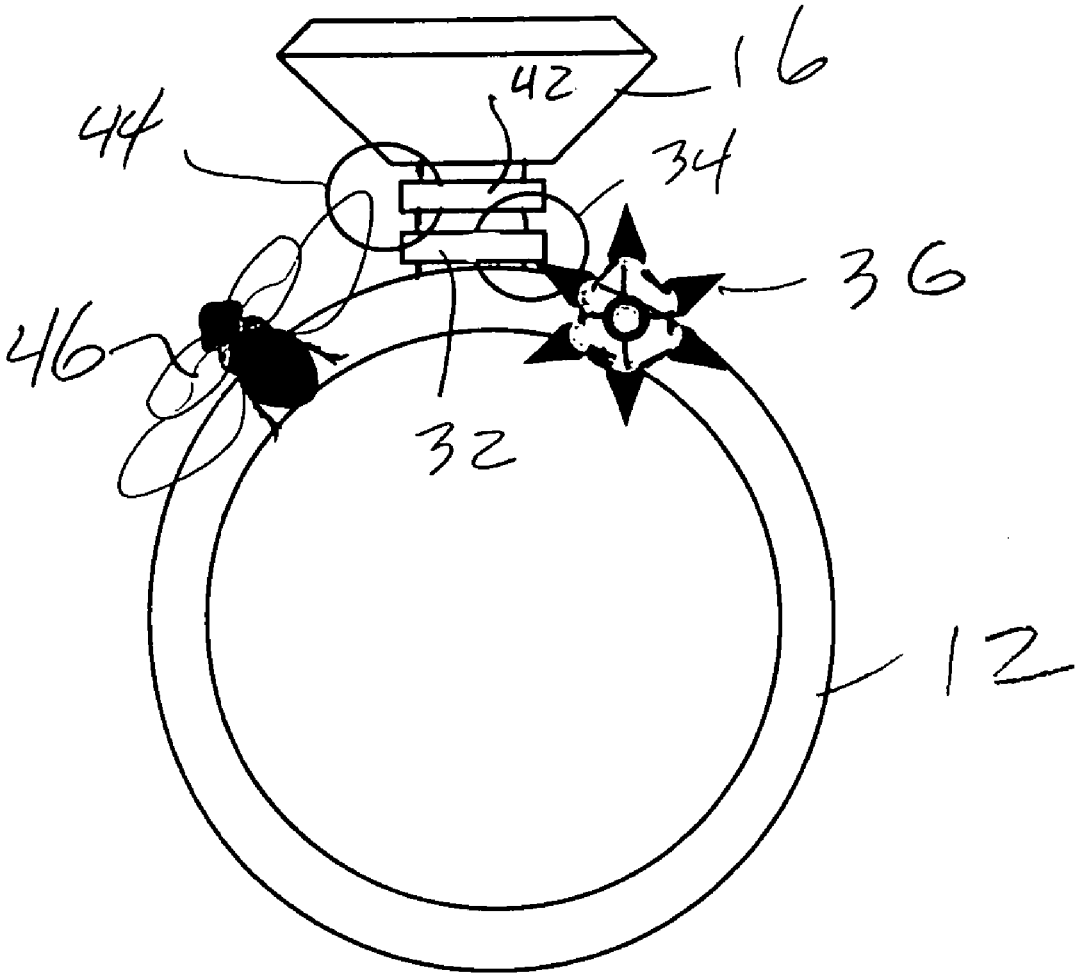
FIG. 4 is a view similar to FIG. 3 showing multiple charms attached to the same ring.

Turning now to FIG. 3 and with reference to FIGS. 1 and 2, according to the methods of the invention, the setting 16 is separated from the post 14 as shown in FIG. 1. The loop 22 of the charm 20 is placed over the post 14 and the setting is 16 is reattached to the post as shown in FIG. 3. The chain link(s) 24 form(s) a chain which is preferably short enough so that when it is attached to the post, the charm does not hang between the wearer's fingers. According to the preferred methods of the invention, up to three or more charms may be attached to the ring at any one time. FIG. 4 shows a ring with two charms 36 and 46 each coupled to a chain link 34, 44 coupled to a loop 32, 42. The loops 32, 42 are positioned over the post as shown with the setting on top. It will be appreciated that in order to accommodate multiple charms, the post may need to be elongated beyond the depth of the internal threads in the setting. If this is the case, blank spacer loops (i.e. without a charm) may be provided to cover exposed portions of the stem when fewer than the maximum number of charms are attached.

Figure 6:
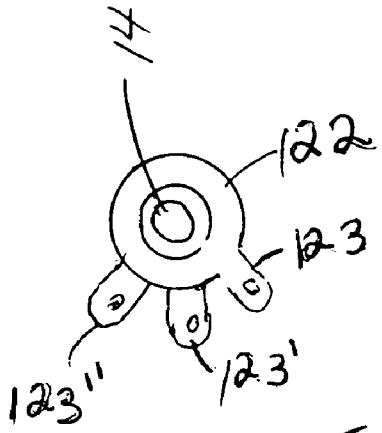
FIG. 6 is a schematic top view of three washers according to the invention.
Figure 5:
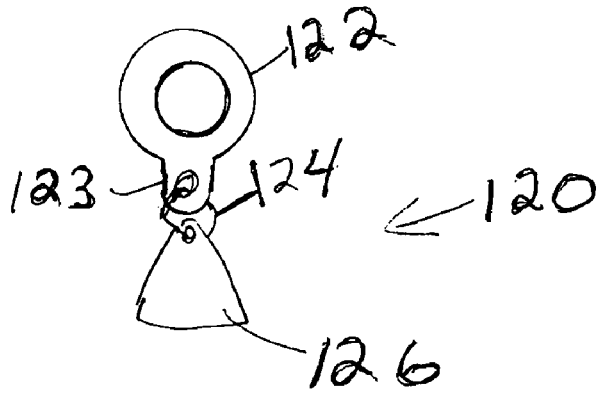
FIG. 5 is a schematic side elevation view of another charm according to the invention.

FIG. 5 shows an alternate embodiment of a charm 120. The charm includes a loop 122 coupled by a link 124 to a charm element 126. According to this embodiment, the loop 122 has an ear 123 through which the link 124 extends. This ear allows the stacking of several loops on a post as shown for example in FIG. 6 (with the charm elements and links removed for clarity). There it can be seen that three loops having ears 123, 123', and 123" are placed over post 14 with the ears circumferentially spaced apart. This arrangement allows the loops 122 to lie flat without the links 124 interfering.

Figure 7:
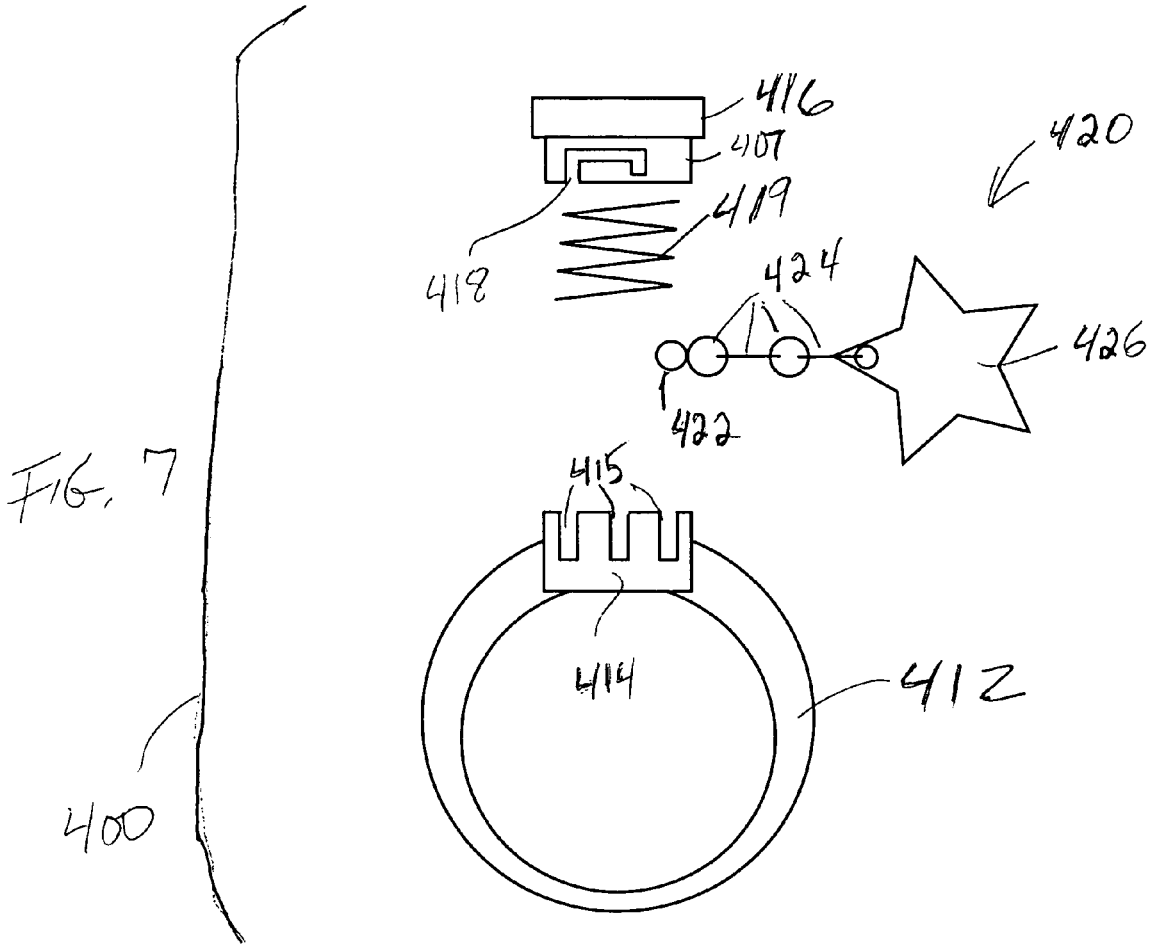
FIG. 7 is a schematic exploded side elevation view of a second embodiment of a ring according to the invention.
Figure 8:
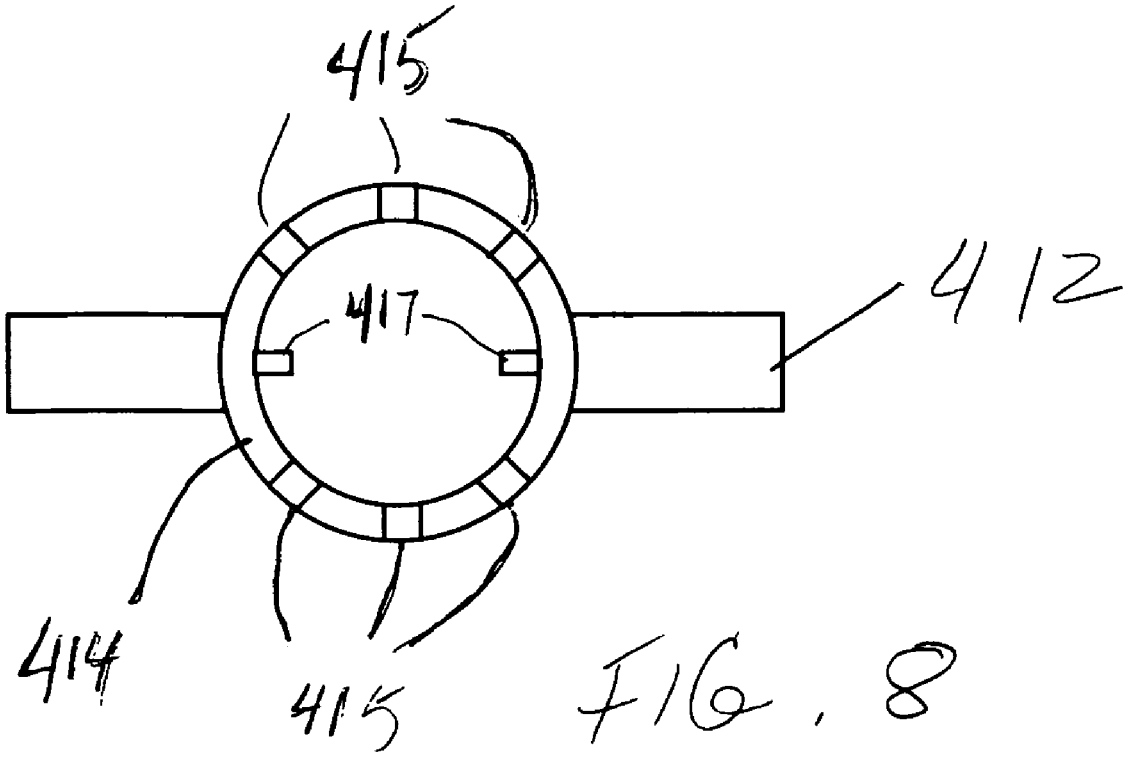
FIG. 8 is a schematic top view of the ring of FIG. 7 with the setting and charm removed.

FIGS. 7 and 8 illustrate a second embodiment of a ring and charm assembly according to the invention. The assembly 400 includes a closed loop (ring) 412 which is dimensioned to fit comfortably over the wearer's finger. A substantially cylindrical "basket" 414 is mounted radially relative to the loop 412, The basket has a plurality of circumferential slots 415 and a pair of diametrically opposed interior bosses 417 (FIG. 8). A removable setting 416 is provided with a lower cylinder 407 having an external diameter smaller than the internal diameter of the basket 414. The cylinder 407 has a pair of diametrically opposed bayonet slots 418 which are dimensioned to receive respective bosses 417 on the basket 414 and a spring 419 having a diameter smaller than the interior diameter of the cylinder 407 is also provided. A charm 420 includes a mounting anchor 422 coupled by one or more links 424 to a charm element 426. The mounting anchor (e.g. a ball) 422 has a diameter larger than the width of the slots 415 and the link 424 immediately connected to the anchor 422 has a dimension which is narrower than the width of the slots 415. From the foregoing, those skilled in the art will appreciate that the ring and charm(s) are assembled by placing the anchor(s) 422 in slot(s) 415, placing the spring 419 into the basket 414, placing the cylinder 407 over the spring 419, pressing the setting 416 into the basket with the opening to the bayonet slots 418 receiving the bosses 417, then turning the setting 416 until the bayonet slots 418 fully engage the bosses 417. When the setting 416 is released, the spring 419 will force the setting up slightly, thereby engaging the bosses in the vertical ends of the slots 418. In order to remove the setting, it must be pushed against the spring and turned in the opposite direction. So long as the setting is captured by the bosses, the ends of the slots 415 are covered by the setting and the charm(s) 420 are securely attached to the ring. It will also be appreciated that this arrangement of a slotted basket spring and bayonet lock can be applied to pendants and necklaces as well.

Figure 9:
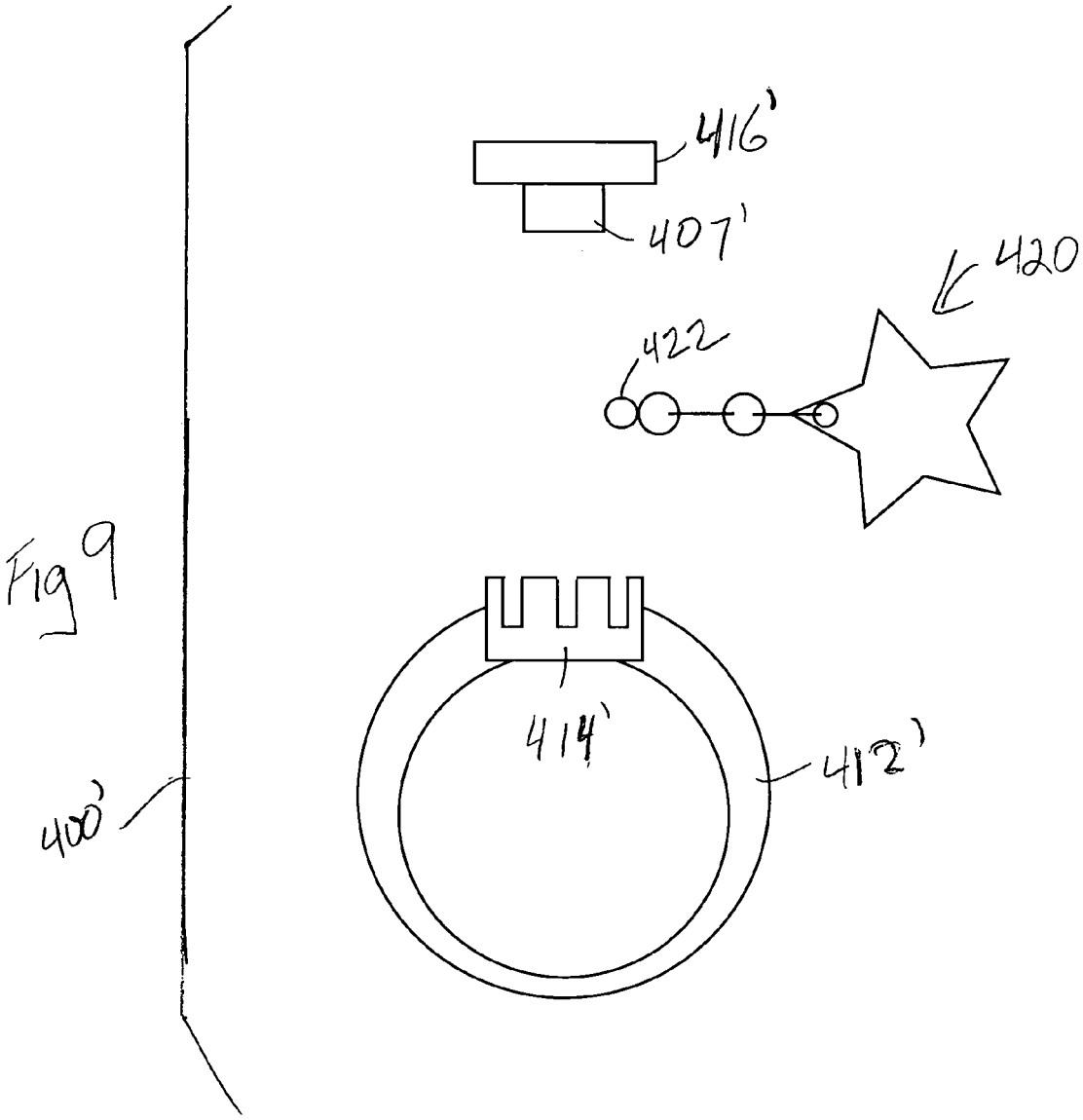
FIG. 9 is a schematic exploded side elevation view of a third embodiment of a ring according to the invention.
Figure 10:
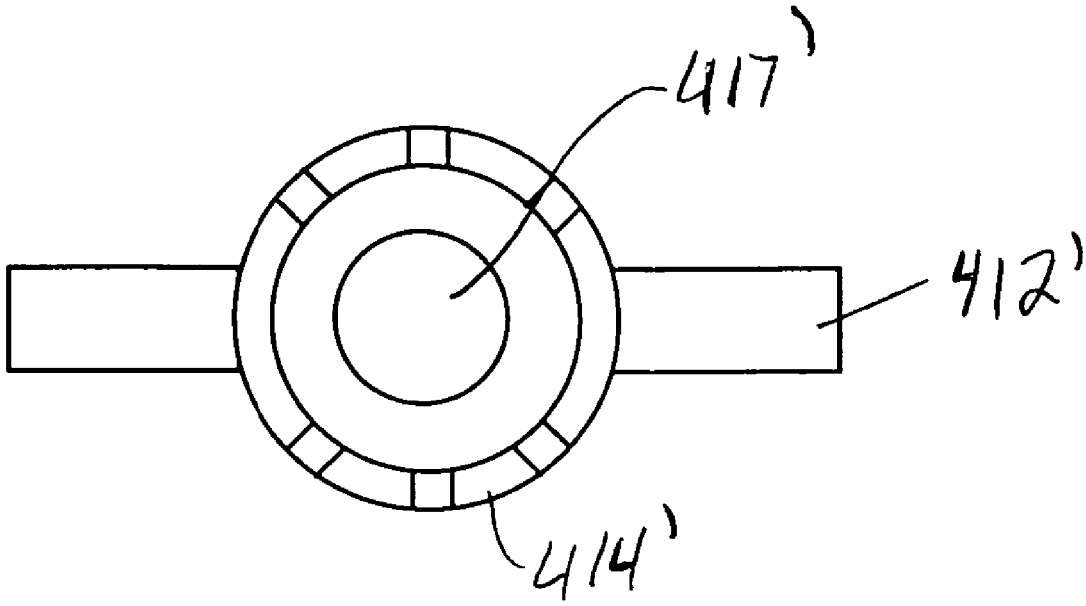
FIG. 10 is a schematic top view of the ring of FIG. 9 with the setting and charm removed.
Figure 11:
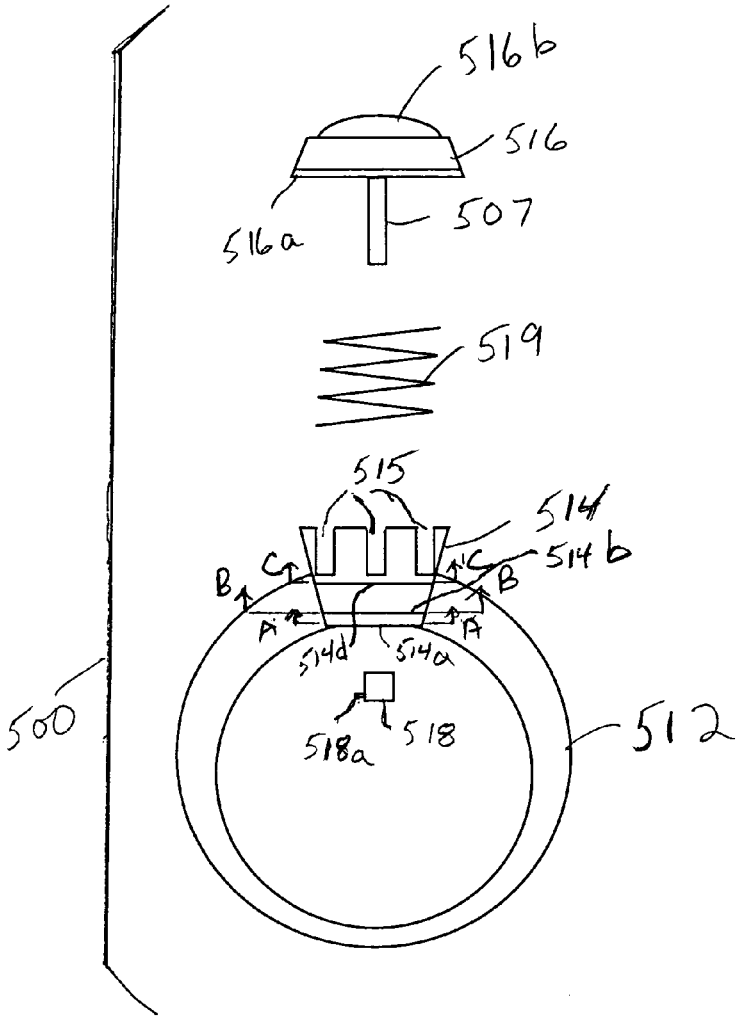
FIG. 11 is a schematic transparent exploded view illustrating a third embodiment of the invention.
Figure 14:
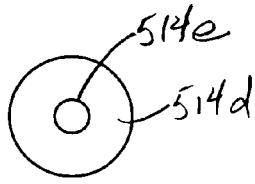
FIG. 14 is a section taken along line C-C in FIG. 11.
Figure 13:
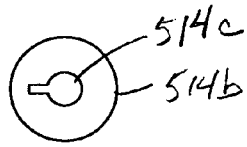
FIG. 13 is a section taken along line B-B in FIG. 11.

FIGS. 9 and 10 illustrate a third embodiment of a ring and charm assembly according to the invention. The assembly 400' is similar to the assembly 400. The difference is that there is no spring nor is there a bayonet coupling. In this embodiment the removable setting 416' has a post 407' and the basket 414' has a pad 417'. Either the post or the pad or both are magnets. Alternatively, one is a magnet and the other is a ferrous material. The post 407' has a diameter which is small enough to leave space between it and the basket for the charm anchors 422.

Figure 12:
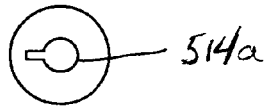
FIG. 12 is a section taken along line A-A in FIG. 11.
Figure 15:
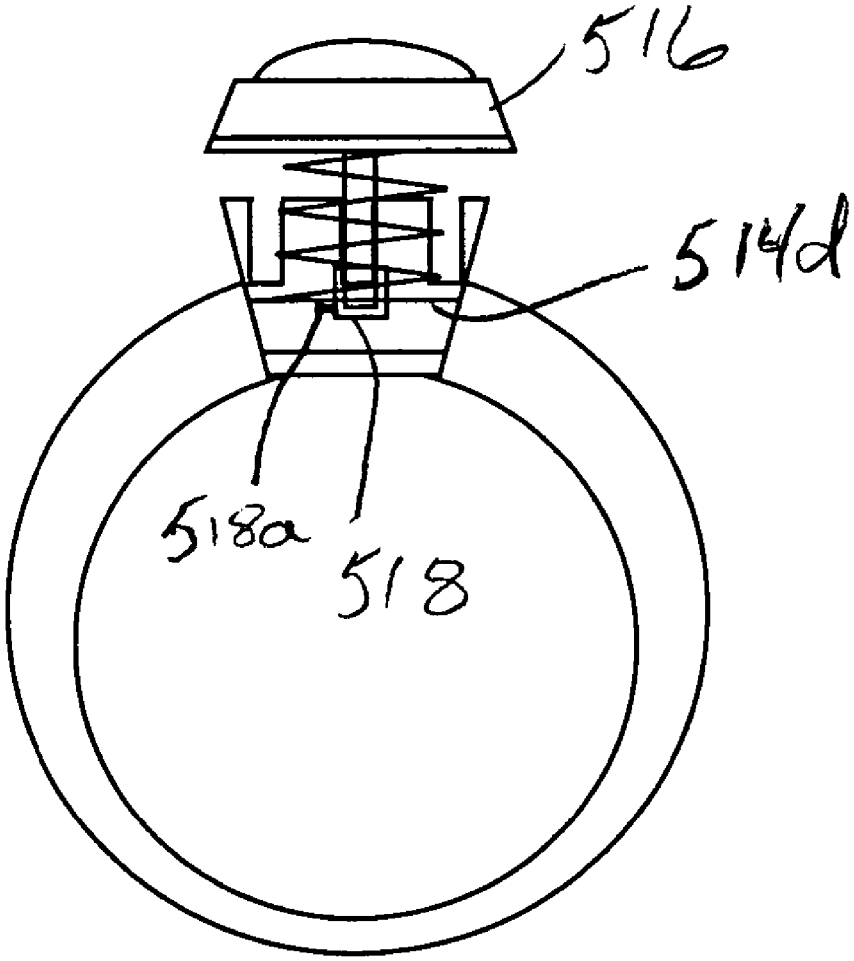
FIG. 15 is a schematic transparent side elevation view of the fourth embodiment assembled and with the setting moved to the upward open position.

FIGS. 11 through 16 illustrate a fourth embodiment of a ring assembly 500 according to the invention. The assembly includes a closed loop (ring) 512 with a frustroconical basket 514 mounted thereon. The basket 514 is provided with a plurality of slots 515 like the slots 415 in the second and third embodiments and they are dimensioned to capture charms of the type 420 (FIGS. 7 and 9). A frustroconical setting 516 has a lower lip **516*a* which has a slightly larger diameter than the top of the basket 514. The setting 516 has an upper decorative stone 516*b* and a lower downward extending stem 507. A small cylinder 518 is provided with a radial boss 518*a* and a spring 519 is also provided. The bottom of the basket 514 has a keyhole 514*a* as shown in FIG. 12. A first disk 514*b* with a similar keyhole 514*c* is located inside the basket spaced up from the bottom of the basket. A second disk 514***d* having a circular hole 514*e* is located inside the basket 514 between the first disk 54*b* and the slots 515. The keyholes 514*a* and 514*c* are dimensioned to allow the passage of the cylinder 518 and boss 518*a*. The circular hole 514*e* is dimensioned to allow the passage of the cylinder 518 but not the boss 518*a*. The stem 507 is dimensioned to fit through all of the holes 514*a*, 514*c*, 514*e* an into the cylinder 518.

Figure 16:
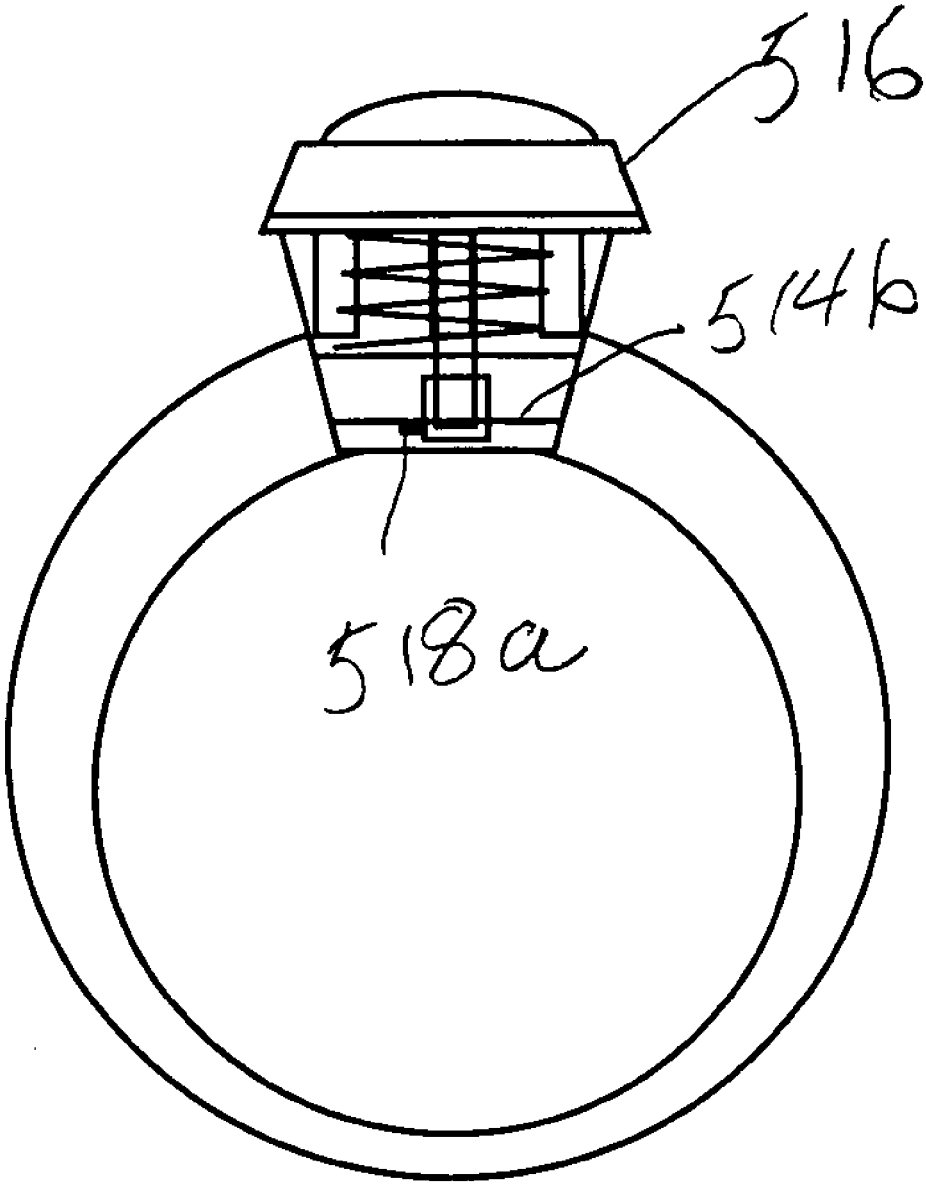
FIG. 16 is a schematic transparent side elevation view of the fourth embodiment assembled and with the setting moved to the downward closed position.

The ring assembly 500 is put together by placing the spring 519 into the basket 514 where it rests upon the disk 514*d*. The stem 507 of the setting 516 is then inserted through the spring and through the hole 514*e*. The setting is pressed down against the spring until the stem 507 extends through the hole 514*c* and into the hole 514*a*. The length of the stem is preferably long enough to lie flush with the bottom of the basket but not pass through it. The cylinder 518 with its boss 518*a* is then pressed through the keyhole 514*a* and onto the bottom of the stem 507. The cylinder is secured to the stem by any one or more of: force fitting, welding, gluing, etc. With the cylinder 518 securely coupled to the stem 507 of the setting, the setting can be released and, if the boss 518*a* is aligned with the keyway in the hole 514*c*, the spring 519 will lift the setting up to the position shown in FIG. 15 with the boss abutting the underside of the disk 514*d*. Pushing the setting down with the boss aligned with the keyway in the hole 514*c* will locate the boss beneath the disk 514*b* as shown in FIG. 16. Turning the setting so that the boss is no longer aligned with the keyway will trap the boss beneath the disk 514*b*. In this position, the lip 516*a* of the setting overlies the top of the basket 514.

It will be appreciated that in the embodiment pictured and described, the setting is free to rotate 360°. According to a preferred realization of this embodiment, rotation of the setting is limited to about 90° from an open to closed position. This is accomplished by placing rotation limiting structures (not shown) on the disks 514*b* and 514*d*.

Figure 17:
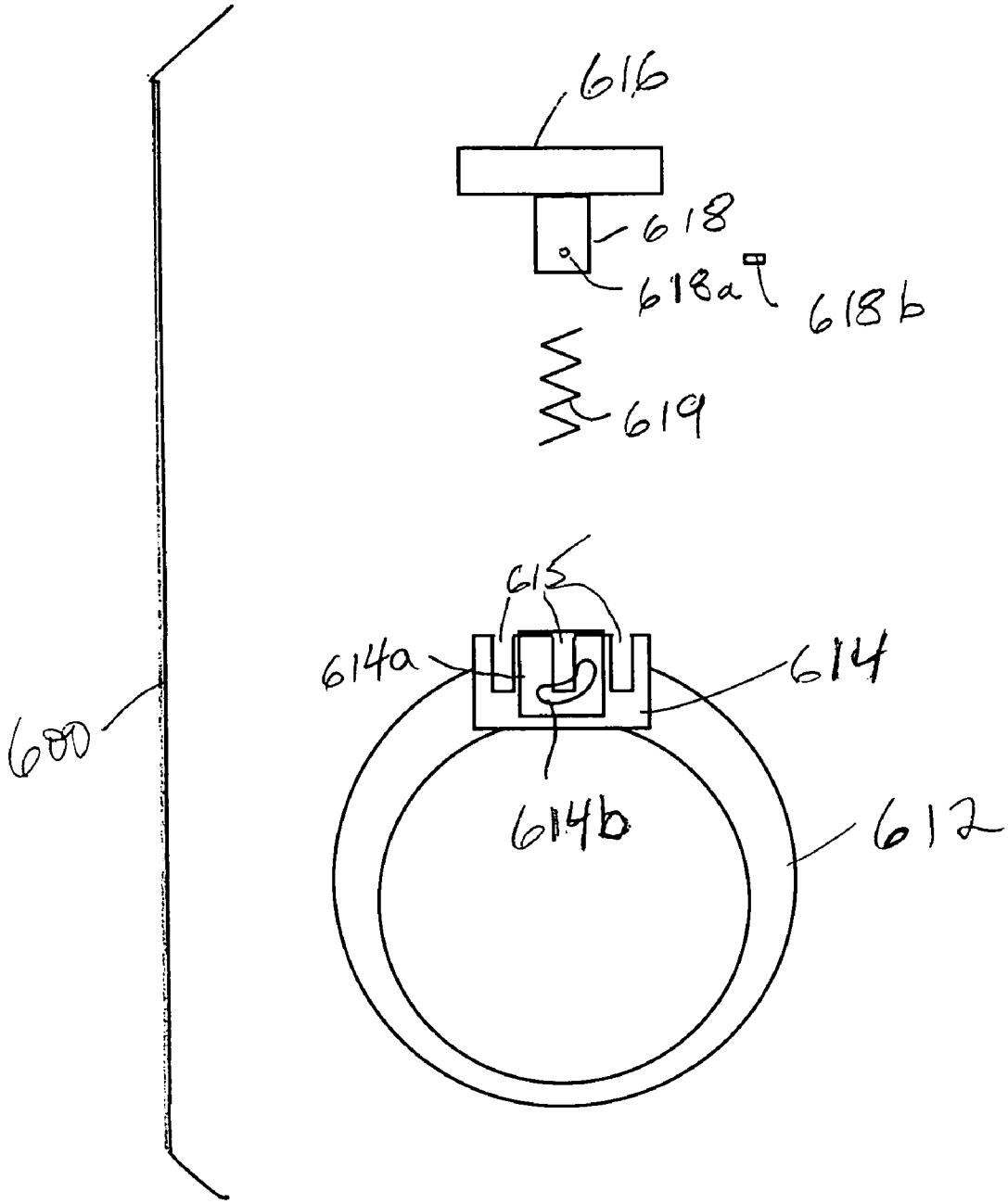
FIG. 17 is a schematic transparent exploded view illustrating a fifth embodiment of the invention.

FIG. 17 shows a fifth embodiment of a ring assembly according to the invention. The assembly includes a closed loop (ring) 612 and a basket 614 having slots 615. The setting 616 has a centrally located downward extending hollow post or cylinder 618 with a radial opening 618*a* dimensioned to receive a radial boss 618*b*. The basket 614 is provided with a central cylinder 614*a* which has a bayonet slot 614*b*. The bayonet slot is preferably L-shaped, J-shaped, or boomerang shaped. A spring 619 is provided and is dimensioned to fit inside the post 618. The cylinder 614*a*, the hollow post 618, and the boss 618*b* are dimensioned such that the post 618 fits inside the cylinder 614*a* and the boss 618*b* extends into the slot 614*b*.

The assembly 600 is put together inserting the spring 619 into the post 618, inserting the post and spring into the cylinder 614*a*, and inserting the boss 618*b* through the slot 614*b* into the radial hole 618*a* in the post 618. An alternate assembly method is to continue the slot 614*b* to the top of the cylinder 614*a* so that the post 618 with the boss 618*a* can be inserted into the cylinder and slot and then sealing off the top of the slot by welding or the like. Still another assembly method is to pull the boss out of the post into the slot after it is in the cylinder.

Figure 18:
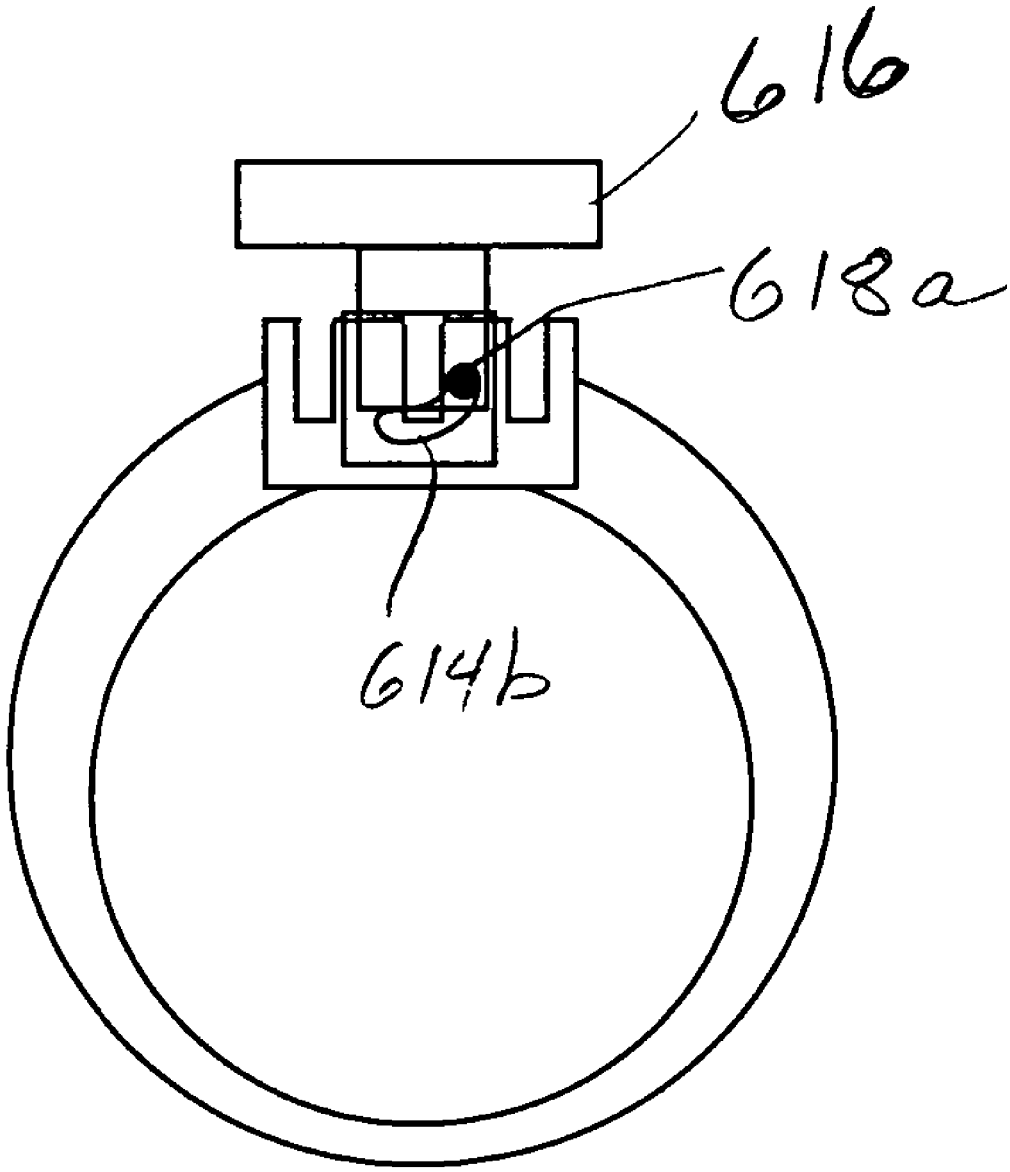
FIG. 18 is a schematic transparent side elevation view of the fifth embodiment assembled and with the setting moved to the upward open position.

When the assembly is put together as shown in FIG. 18, the setting 616 is biased upward and can be turned with the boss riding in the bayonet slot to an upward open position (shown) or to a downward closed position (not shown). This embodiment uses the same type of charms (420 in FIGS. 7 and 9) as described above.

From the foregoing, it will be appreciated that the rings according to the invention all define a finger axis at the center of the closed loop and a setting axis which is perpendicular to the finger axis. Charms are attached to the rings (captured by the settings) on an axis substantially perpendicular to the setting access (not accounting for the flexibility of the link(s) coupled to the charms).

There have been described and illustrated herein several embodiments of a finger ring and methods of assembling it. While particular embodiments of the invention have been described, it is not intended that the invention be limited thereto, as it is intended that the invention be as broad in scope as the art will allow and that the specification be read likewise. Thus, while a ring with up to six charms has been disclosed, the maximum number of charms could be greater or fewer. Also while charms have been shown with a chain or chain link connecting them to an end which is captured by a charm capturing fixture (e.g. threaded post or slot in a basket), the charms could be coupled by any flexible or rigid member to an end which is captured by a charm capturing fixture. It will therefore be appreciated by those skilled in the art that yet other modifications could be made to the provided invention without deviating from its spirit and scope as claimed.

What is claimed is:

1. A finger ring, comprising:

a charm capturing fixture;

a movable setting movable relative to said charm capturing fixture;

a plurality of charms, each charm coupled to an anchor which is captured by said charm capturing fixture when said movable setting is in a first position relative to said charm capturing fixture and can be independently removed when said movable setting is in a second position relative to said charm capturing fixture, wherein said charm capturing fixture is a post with a first mating element, said setting having a second mating element removably coupled to said first mating element, and said anchor which is captured by said post is a loop.

2. A finger ring according to claim 1, wherein:

said first mating element includes threads on said post and said second mating element includes internal threads in said setting.

3. A finger ring according to claim 1, wherein:

said movable setting is fitted with an upper decorative stone.

4. A finger ring comprising:

a charm capturing fixture;

a movable setting movable relative to said charm capturing fixture;

a charm coupled to an anchor which is captured by said charm capturing fixture when said movable setting is in a first position relative to said charm capturing fixture and can be removed when said movable setting is in a second position relative to said charm capturing fixture, wherein said charm capturing fixture is a slotted basket and said movable setting is coupled to said slotted basket by a bayonet mount.

5. A finger ring according to claim 4, further comprising:

a spring located between said slotted basket and said movable setting.

6. A finger ring according to claim 5, wherein:

said slotted basket has two spaced apart disks, a lower disk defining a keyhole and an upper disk defining a circular hole, said movable setting has a downwardly extending post with a radial boss, said post and said boss being movable through said keyhole but said boss being blocked by said upper disk.

7. A finger ring according to claim 5, wherein:

said slotted basket has a centrally located cylinder, and said movable setting has a centrally located post which extends into said cylinder.

8. A finger ring according to claim 7, wherein:

said post has a radially extending boss, and said cylinder has a bayonet slot which is engaged by said boss.

9. A finger ring according to claim 5, wherein:

said slotted basket has a pair of bosses and said movable setting has a pair of mating bayonet slots.

10. A finger ring according to claim 4, wherein:

said movable setting is coupled to said slotted basket by a magnet.

11. A finger ring according to claim 4, wherein:

said movable setting, when in said first position, presents a generally cylindrical appearance.

12. A finger ring, comprising:

a closed loop defining a finger axis;

a movable setting coupled to said closed loop and being movable from a first position to a second position relative to said closed loop along a setting axis which is substantially perpendicular to said finger axis;

a charm coupled to an anchor which is captured when said movable setting is in said first position and can be removed when said movable setting is in said second position, wherein said setting remains coupled to said closed loop when in both said first and second positions.

13. A finger ring according to claim 12, wherein:

said setting is coupled to said closed loop by a bayonet mount.

14. A finger ring according to claim 13, further comprising:

a spring located between said closed loop and said setting.

15. A finger ring according to claim 14, further comprising:

a slotted basket mounted between said closed loop and said setting.

16. A finger ring according to claim 15, wherein:

said bayonet mount includes a cylinder inside said basket, said cylinder having a slot.

17. A finger ring according to claim 16, wherein:

said bayonet mount further includes a post extending from said setting into said cylinder.

18. A finger ring according to claim 17, wherein:

said bayonet mount further includes a radial boss extending from said post into said slot of said cylinder.

19. A finger ring according to claim 12, wherein:

said movable setting is coupled to said closed loop by a magnet.

20. A finger ring according to claim 12, wherein:

said movable setting, when in said first position, presents a generally frustoconical appearance and is fitted with an upper decorative stone.

* * * * *